US005185920A

United States Patent [19]

Aguilo

[11] Patent Number: 5,185,920

[45] Date of Patent: Feb. 16, 1993

[54] INSTALLATION AND METHOD FOR CARRYING OUT METALLIC REINFORCEMENTS

[76] Inventor: Jasime Aguilo, Maria i Jose St., 07440-Muro (Mallorca), Spain

[21] Appl. No.: 794,374

[22] Filed: Nov. 14, 1991

Related U.S. Application Data

[63] Continuation of Ser. No. 557,040, Jul. 25, 1990, abandoned.

[30] Foreign Application Priority Data

Aug. 3, 1989 [ES] Spain ..... 8902759

[51] Int. Cl.[5] ..... B23P 19/04

[52] U.S. Cl. ..... 29/794; 29/824; 29/897.33; 29/897.34

[58] Field of Search ..... 29/428, 429, 430, 431, 29/824, 897, 897.33, 897.34, 897.35, 791, 793, 794, 795, 822, 823; 52/745

[56] References Cited

U.S. PATENT DOCUMENTS

| | | | |
|---|---|---|---|
| 1,693,987 | 12/1928 | Koelkebeck | 29/897.35 X |
| 2,696,729 | 12/1954 | Heyden | 29/897.34 X |
| 3,052,140 | 9/1962 | Guyer, Jr. | 29/897.35 X |
| 3,860,781 | 1/1975 | Aschauer et al. | 29/897.35 X |
| 3,874,062 | 4/1975 | Muto et al. | 52/745 X |
| 4,614,013 | 9/1986 | Stevenson | 29/897.34 |

FOREIGN PATENT DOCUMENTS

| | | |
|---|---|---|
| 2570625 | 3/1986 | France . |
| 2623548 | 5/1989 | France . |

OTHER PUBLICATIONS

A. Tretyakov, M. Rozhnenko, "Armaturnye i betonnye raboty", 1988, pp. 63–72, (A published paper of the USSR State Committee for Inventions and Discoveries).

*Primary Examiner*—Joseph M. Gorski
*Assistant Examiner*—Peter Dungba Vo
*Attorney, Agent, or Firm*—Browdy and Neimark

[57] ABSTRACT

An installation for carrying out assembly of metallic reinforcements for construction and public works, in which trestle bents (A-frames) are arranged on moving wagons or carts that slide along rails. The workers remain stationary while the reinforcements move to their work stations so that each of their sections can be bound together. There is one area for loading, another for the binding itself, and a third for unloading, preferably arranged in a closed circuit.

9 Claims, 2 Drawing Sheets

INSTALLATION AND METHOD FOR CARRYING OUT METALLIC REINFORCEMENTS

This application is a continuation of application Ser. No. 07/557,040, filed Jul. 25, 1990, now abandoned.

BACKGROUND OF THE INVENTION

The patent deals with reinforcements used in construction, such as in pillars, beams, supports, girders, etc. The manufacture of reinforcements of this kind is carried out either on site, where the construction is taking place, or in a factory, in which case the prepared reinforcement are transported to the construction site to be arranged in the place in question, that is, for assembly.

A method of carrying out the manufacturer of these reinforcements either on site or in a factory, begins by which a first cutting and shaping operation is carried out on the different pieces of iron needed for the said reinforcement. These pieces of iron are then placed on tables or trestle bents, where a pre-assembly of the reinforcement to be made is carried out. Next, the workers proceed to bind together the meeting points of the pre-assembled reinforcement in the places in question, with the reinforcement being static on the trestle bents and the worker or workers moving along its length until all the necessary points have been bound together, thus giving shape to the reinforcement.

For binding together the meeting points, the traditional way is known, based on manually placing a wire at each point and later braiding it by means of a tool, for instance a pair of pliers or pincers.

This traditional system needs specially skilled workers, called steel erectors or steelworkers, who usually develop a high level of production, in the region of 45 to 50 Kg. of iron per hour and even up to 60 Kg. of iron per hour per person. The problem with this traditional method of assembly lies in the high production costs, due especially to the high cost of skilled labour and its scarcity as workers of this kind are needed by all constructors.

More recently, pre-shaped clips are being used which are fitted where the reinforcement members cross. These clips are provided with projections which are picked up by a tool which automatically braids the said projections until a perfect closure of the clip is obtained.

The advantage of using clips and automatic braiding tools is that highly skilled labour is not needed but that semi-skilled workers and even apprentices can be used. In this case, the production is similar to the previous system, although with the inherent advantage of employment of less skilled workers and the possibility of finding suitable personnel.

The system of welding the pre-assembled reinforcement at the meeting points by using skilled labour is also known. Apart from the kind of welding to be used, with or without flux, the production in Kilograms per hour per person will remain at a maximum of 60 and the welded reinforcement will be more rigid, which is not advisable.

With slight differences, the workers move along the structure in all these methods of carrying out the work, whereas the structure remains static until it is completely bound together and ready for its assembly or transport. Therefore, in all the systems known up to now, these two constants are present: the reinforcements remain static while the workers move. Also in general terms, the production turns out to be limited, as has already been stated, with the maximum amount being some 60 Kg. per hour per person.

More recently, known by means of the French patent 84.14888 of LAFON, is a type of installation based on a flexible machine which has an area for the longitudinal iron parts of the structure to be arranged and another adjacent area for the transverse iron parts, which are stacked up. In this installation, traction on the longitudinal iron parts is carried out amoung the stacked transverse iron parts, taking one transverse iron part each time, which is bound in the traditional way until the structure is completed.

This installation is complex in itself and in the way of proceeding to make up the structure, meaning that its use in practice is not viable given that it is neither cheaper than traditional processes nor increases production.

SUMMARY OF THE INVENTION

One aim of the present invention is to attain a method of production which provides a greater output of reinforcements of the order of at least 30 percent and usually 50 percent more in equality of conditions, with which the cost of the finished reinforcement can be quite considerably cheapened, even taking into account the amortization or repayment for the installation and the tools.

Another aim of the patent is to obtain an automatic or semi-automatic installation which moves the reinforcements for their pre-assembly and assembly, and in which the workers remain static while the reinforcements are moved in front of their work stations.

To put the present invention into operation, pre-shaped clips and braiding tools are used, after the clips have first been positioned by the worker or operator. Each worker is provided with an automatic braider and a sufficient amount of clips to be arranged at the binding points of each reinforcement. The operations of cutting and shaping the pieces of iron are carried out in the same way as with the traditional methods, with the special features of the present invention coming in after the shaping of the components.

The present invention includes the existence of a set of wagons or carts on which are situated the trestle bents or A-frames that receive the already shaped pieces of iron, in that these wagons are fitted with suitable means of rolling along rails so that they can move in at least one direction. When the different pieces of iron have been suitably cut and shaped, the pre-assembly of the reinforcement is carried out on the trestle bents on the said wagons.

In this situation, each wagon is moved along the rails of this pre-assembly area to another rail in which means are fitted to move the wagons at a variable speed and in that these means go together with other ones in the lower part of each wagon. Normally in this binding line, a variator motor is provided, with a connection on its shaft outlet for an endless chain of a similar length to that of the rail; this endless chain will engage with the projections on the wagons and move them along the assembly track.

On this assembly track, the reinforcement on the wagons circulates at a certain speed while the workers remain stationary, binding together the meeting points of the reinforcement with the clips and the braiding machine as each section of the reinforcement passes in front of their work stations.

The number of workers is logically variable, given that it is obvious to point out that, in general terms, a greater work rate can be achieved with a higher number of operators.

The traverse speed of the wagons which carry the reinforcement is variable, as was stated previously, and it should be considered that with an equal number of operators or workers, the speed of the wagon will be slower when the reinforcement is more complex and has a greater number of binding points in each section.

At the end of the work track, any specific reinforcement will be completely finished and ready to be moved into stock, loaded onto a lorry, etc. It must be considered here that the pieces of iron for assembly of the reinforcement on site are placed on the wagon at the beginning of the process along with the pieces which were used to make the reinforcement itself, so that when the reinforcement is finished, these pieces of iron can be held with the reinforcements so that they are controlled until the time of assembly on site.

When the reinforcement has been taken off the wagon, this wagon moves to another area on rails, adjacent to the work area, where the wagons can be loaded again before moving to another or to the first assembly line.

The possible combinations of work tracks and pre-assembly areas, as well as unloading areas, are infinite and will depend, as is logical, on variables, such as the space available, the capacity that the installation is to be provided to, etc., as will be pointed out later in relation with the drawings.

In the pre-assembly areas, the wagons can be provided, if desired, with a gentle traverse movement towards the work track, and the worker or workers could perfectly carry out the pre-assembly of the reinforcement during this movement.

BRIEF DESCRIPTION OF THE DRAWINGS

For purposes of clarification, and as an example, the accompanying sheets of drawings show an example of an installation in which the procedure laid down in this specification could be applied.

DETAILED DESCRIPTION OF THE PREFERRED EMBODIMENTS

Figure 1:
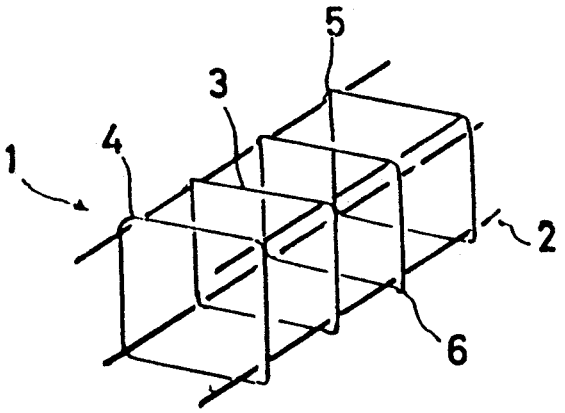
FIG. 1 shows, partially, a simple reinforcement.
Figure 2:
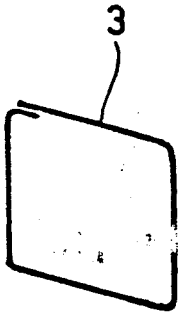
FIG. 2 shows a piece of iron, a stirrup or hoop in this case, pre-shaped for fitting into the reinforcement.

As can be observed in FIGS. 1 and 2, a pre-assembled reinforcement 1 is based on longitudinal pieces of iron 2 and transverse iron stirrups or hoops 3, which must be joined together with wire at the meeting points, for instance at 4, 5, and 6 etc. with the help of already pre-shaped clips which are placed at these points and with tools that braid together the ends of these clips.

Figure 3:
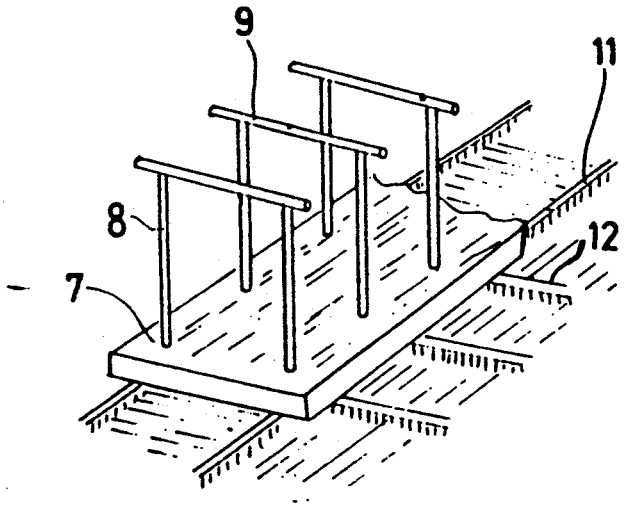
FIG. 3 shows a wagon on which the reinforcements can be placed.

FIG. 3 shows a wagon or cart 7 on which a structure based on trestle bents or A-frames 8–9 has been mounted to procure a support base for the reinforcements. The wagon moves along rails 11 and 12 using its own means of rolling, which are not shown but could be, for instance, wheels, bearing, etc.

Figure 4:
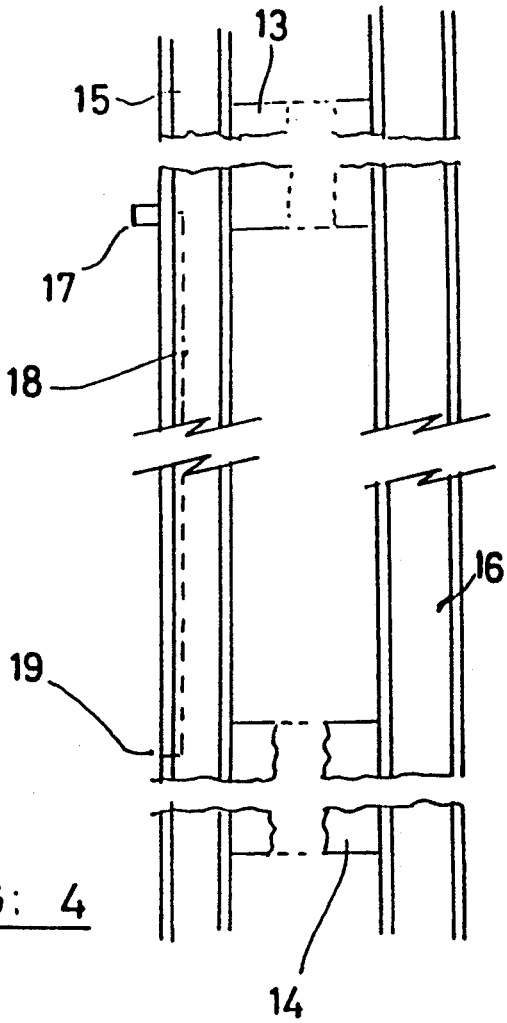
FIG. 4 is a layout diagram of a possible installation.

With reference to FIG. 4, we can see the arrangement of a model installation as an example, according to which there is a pre-assembly area 13 in which the wagons with the reinforcements receive the pieces of iron and travel to an adjoining area 15 where the wagons are engaged by a chain 18 driven by a variator motor 17. In this area, the workers or operators remain stationary and while the reinforcement moves in front of them can carry out the binding together of the points in each section. At the end of its travel, for example in position 19, the reinforcement is now completely finished and ready to be stored or loaded onto a lorry for site delivery.

The wagons which are left free move to area 14, which might be another pre-assembly area, for example, from which the wagons move to area 16, where these reinforcements are bound together by another group of workers. This order or succession might be altered, making area 16 a return area only for the empty wagons from the first pre-assembly area 13. This situation would respond, for example, to the fact of only one group of workers being available.

Figure 5:
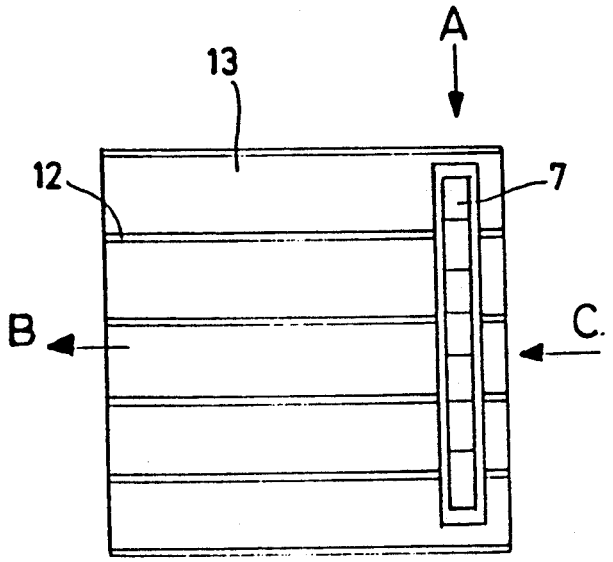
FIG. 5 shows a detail of FIG. 4.

In FIG. 5 we can see an enlargement of the preassembly area 13 and the position of one of the wagons 7 with the trestle bents. A indicates the direction in which the pieces of iron enter onto the trestle bents, which enter from direction C. The wagons 7, once loaded with the pre-assembled reinforcements, are transferred in direction B towards the binding line.

Figure 6:
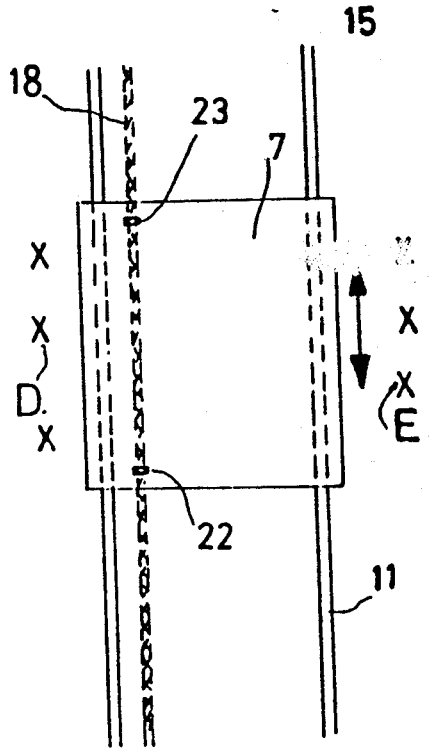
FIG. 6 deals with the wagon mounted on the rails of the binding track.

FIG. 6 shows a wagon 7, illustrated here without either trestle bents or reinforcements, on the rails 11 of the binding area. The aim of D and E is to indicate the work stations of the operators, in this case on both sides of the wagon, when it is moved by the action of the chain or rack rail 18 on the stops 23 and 22 of the wagon itself.

Figure 7:
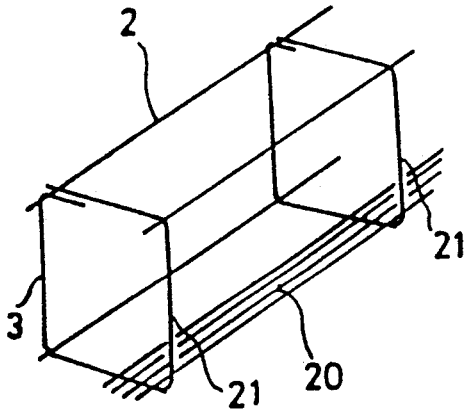
FIG. 7 shows, partially, a reinforcement with the pieces of iron for assembly.

In FIG. 7 we can observe the final position of the assembly irons 20, which are placed on the reinforcement and bound to it, specifically to the stirrups 21, once that the other meeting points have been consolidated.

Figure 8:
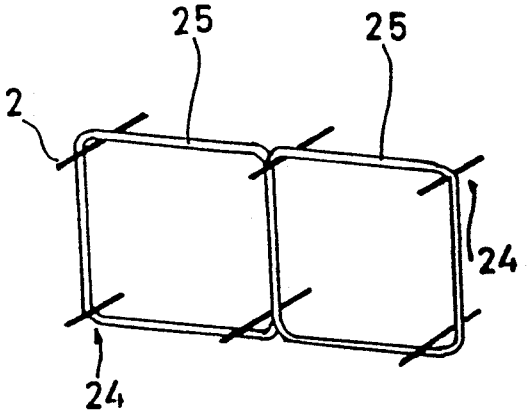
FIG. 8 represents a section of a more complicated reinforcement.

FIG. 8, finally, shows a reinforcement with a greater number of binding points 24 to stirrups or hoops 25 in each section, than the one shown in FIG. 1. This and other types of reinforcements which are more complex or for special applications can be dealt with by the procedure which is proposed in this specification.

On the other hand, it is pointed out that for reinforcements of the kind described, and in normal conditions, a wagon of approximately 11 meters in length has proved to be the most advisable size for practical reasons.

The installation described up to present is situated on rails arranged on the floor of a certain bay. For the purposes in question, it is pointed out that the same arrangement can be carried out aerially, so that the trestle bents (A-frames) rest on hooks or similar at a certain distance from the ground.

The installation and operation method in the application are basically as follows:

A first zone (13) wherein the iron parts which are part of a given metal structure are loaded, marked and pre-assembled in and on a number of racks placed on carriages which run on rails. The carriages generally remain stationary in this zone and the set of iron parts on the racks are all those necessary for a given structure.

At least a second zone (18) wherein the carriages with the racks and iron parts of the pre-assembled structure move at a given speed, passing through points where operators fasten the points of intersection of the iron parts until they are fully reinforced.

A possible unloading zone (14) for the frames. This zone may potentially be used for unloading, and then loading again for the purpose of running through another assembly line (16).

The installation is characterized basically by its simple operation, for example, in comparison with other complex installations for making structures for construction, generally iron work.

I claim:

1. An installation for carrying out the assembly of metallic reinforcements of the type which are used in the preparation of pillars, beams, supports and metallically reinforced construction from pieces of iron which have been cut and bent to a predetermined size and shape, comprising a rail system and areas through which said rail system passes;

mobile wagons arranged to move on said rail system between and through said areas;

racks mounted on said mobile wagons;

a first one of said areas being a pre-assembly area wherein said mobile wagons have the pieces of iron which have been cut and bent to a predetermined size and shape marked and loaded on said racks;

stationary operator work stations;

a second one of said areas being a binding area wherein said mobile wagons move at a predetermined variable speed past said stationary operator work stations and wherein the pieces of iron have points of intersection fastened together forming the metallic reinforcement, said predetermined variable speed determined by the number of points of intersection fastened together and the number of said operator work stations;

said predetermined variable speed in said second one of said area being predetermined by where there is an increase in work stations there is allowed an increase in the predetermined variable speed, with less work stations necessitating a decrease in said speed, but an increase in number of points of intersection fastened together necessitating a decrease in said predetermined variable speed and a decrease in the number of points of intersection fastened together allowing an increase in said speed;

a third one of said areas being an unloading area to unload the pieces of iron having been fastened together as reinforcements;

a fourth one of said areas through which said mobile wagons pass on their way back to said pre-assembly area.

2. The installation in accordance with claim 1 wherein said mobile wagons are movable both forward and backward in said binding area.

3. The installation in accordance with claim 1 wherein said mobile wagons move slowly through said pre-assembly area while the pieces of iron are being marked and loaded.

4. The installation in accordance with claim 1 wherein said pre-assembly area and said unloading area are included in the same area.

5. The installation in accordance with claim 1 wherein said areas are connected in a closed circuit by said rail system.

6. A method of assembly of metallic reinforcements used in construction such as in pillows, beams, supports, and girders comprising the steps of positioning cut and shaped pieces of iron to be used for the reinforcements;

in a first zone, being a pre-assembly area, loading said pieces of iron on trestle bents in a preassembled order positioned relative to each other to form a complete pillow, beam, support, or girder on carts mounted for movement on tracks;

in a second zone, being a binding area, having a plurality of substantially stationary work stations, and locating clips and braiding machines at said plurality of work stations;

moving said carts to said second zone where said carts are movable at variable speeds through said second zone past said plurality of work stations;

binding together predesignated meeting points of said shaped pieces of iron on said carts with said clips and said braiding machines at a plurality of said plurality of work stations substantially at the same time;

and adjusting the speed of movement of said carts past each of said work stations in accordance with the number of binding points to be bound together and number of said work stations;

said variable speed in said second zone dependent on the amount of work stations and the number and complexity of binding points, where there is an increase in work stations there is allowed an increase in the variable speed with less work stations necessitating a decrease in the variable speed, but an increase in number and complexity of binding points necessitates a decrease in the variable speed and a decrease in number and complexity of binding points allows an increase in the variable speed.

7. The method in accordance with claim 6 wherein said carts move slowly through said pre-assembly area while the pieces of iron are being loaded.

8. The method in accordance with claim 6 wherein said pre-assembly area and an unloading area are included in the same area.

9. The method in accordance with claim 6 wherein said carts are movable both forward and backward in said binding area.

* * * * *